United States Patent [19]

Cann

[11] 4,367,629

[45] Jan. 11, 1983

[54] RANKINE CYCLE ENGINE

[76] Inventor: Gordon L. Cann, P.O. Box 279, Laguna Beach, Calif. 92652

[21] Appl. No.: 194,918

[22] Filed: Oct. 7, 1980

[51] Int. Cl.[3] ..... F01K 9/00; F01K 11/04

[52] U.S. Cl. ..... 60/669

[58] Field of Search ..... 60/651, 669, 671, 670

[56] References Cited

U.S. PATENT DOCUMENTS

| | | | |
|---|---|---|---|
| 2,075,648 | 3/1937 | Huttner | 60/669 |
| 3,879,949 | 4/1975 | Hays et al. | 60/649 |
| 3,991,575 | 11/1976 | Bailey et al. | 60/669 |

*Primary Examiner*—Allen M. Ostrager

*Attorney, Agent, or Firm*—Sherman & Shalloway

[57] ABSTRACT

A Rankine cycle engine is disclosed which maximizes heat transfer efficiency between rotor cooling surfaces and coolant disposed within rotor collant passages. Further, internal passages utilize centrifugal pressure to provide accelerated movement of coolant utilizing the principle of the heat pipe. In a first embodiment the stator housing includes an outer chamber which functions as a boiler, heat being provided to this chamber through an outer wall thereof. In a second embodiment an additional internal wall is provided in the stator housing to enable connection of a separate superheater so that additional energy may be provided to the engine when necessary. Modification of the rotor cooling surfaces is also disclosed.

17 Claims, 8 Drawing Figures

RANKINE CYCLE ENGINE

BACKGROUND OF THE INVENTION

1. Field of the Invention

Developments in the state of the art relating to energy use and conservation systems have been directed in two areas: (1) development of energy conversion systems which are more efficient; and (2) development of energy conversion systems which, while likely to be less efficient, provide less costly methods of obtaining energy from less convenient power sources. It is in this latter area that the present invention is directed.

In many cases, the capitalization or maintenance costs make the use of relatively abundant or under-utilized energy sources uneconomical. For example, ordinary sewage is capable of producing a quantity of combustible gases, this production being added by heat resulting from the decomposition of the waste, However, the waste is usually fairly dilute and recovery of large concentrations of usable combustible materials is often uneconomical. Therefore, the development of energy from such a source is not considered to be economically attractive in a short-term sense. However, if a low-grade or dilute output of combustibles can be utilized, the production of energy from such waste composition sources can be economically attractive. There are, of course, numerous sources of small amounts of combustible materials, another example being evaporative losses from stationary storage of voluable fuel.

Additionally, there are numerous sources of low-level heat output, for example, industrial waste heat and even heat exhausted from chimneys of space heating apparatus.

In other cases, energy production is difficult because of the high cost of maintenance of a power plant. This is particularly true in remote locations where on-site access is difficult, as well as in under-developed countries with little or no service capabilities.

One field where maintenance costs are high are in the nuclear industry. In this case, maintenance costs are increased, not because of lack of technical expertise, but because of the difficulty in servicing radioactively-contaminated materials. For example, the placement of an engine physically adjacent to or within a nuclear pile becomes costly, not only because of the thermal problems involved, but because of the radioactive contamination of parts which need to be maintained.

The complexity, and the cost of producing and maintaining a power plant is closely related to the number of moving parts therein. Obviously, it would therefore be desirable to design an engine with as few moving parts as possible.

2. Description of the Prior Art

Sundry proposals have been made directed to simplified Rankine cycle and other heat engines. For example, U.S. Pat. Nos. 3,950,950; 4,009,576 and 4,070,862, all to Doerner and Van Burskik, disclose simplified rotary Rankine cycle engines. In these devices the condenser unit is caused to rotate, and the centrifugal force of rotation is used to control the movement of the working fluid. However, these engines use at least two separate rotary members in addition to the housing or stator member.

Andreas, U.S. Pat. No. 890,591, describes a rotary steam engine in which a disc rotating along with a working member functions as a centrifugal pump to drive the working fluid. However, Andreas does not disclose a rotary condensing chamber and, therefore, necessarily provides his centrifugal pump separately from his working blade space.

U.S. Pat. No. 1,790,196, to Bentley, shows a rotor member in a turbine which has grips or flanges provided thereon for the purpose of absorbing heat from exhaust steam and transferring the heat to within the rotor. However, the turbine described in this patent is of a non-condensing type and, therefore, centrifugal force developed by the rotation of the member could not be applied to pump the working fluid in its liquid form.

Numerous turbine designs make use of insulating coating on turbine materials, including U.S. Pat. Nos. 776,518 and 2,643,852. However, none of these patents discloses the coating of selected portions of turbine members for the purpose of providing separate heat conducting and heat insulating surfaces on a working member to which the working fluid is exposed.

While the prior art does not show a Rankine cycle engine in which all of the component parts are provided integrally with a stator and a unitary working member, the Stirling cycle engine does provide a unitary structure of the working member and the pump. However, the Stirling cycle engine requires a separate condensation means. Furthermore, the Stirling cycle engine has, thus far, not been as readily adapted to the use of a wide variety of fields because heat must be applied at the working chamber. Thus, the Stirling cycle engine provides a structure which is entirely different from even a simplified Rankine cycle engine.

SUMMARY OF THE INVENTION

Accordingly, it is an object of this invention to provide a low-cost engine with as few moving parts as possible.

It is a further object to produce an engine which is inexpensive to produce and which requires a minimum of maintenance.

It is a further object to produce an engine which may be economically utilized with low-grade power sources.

It is a further object to produce an engine which is inexpensive to produce, requires low maintenance and is operable by external combustion means.

These and other objects of this invention are achieved by providing an engine in which a rotary member functions not only as a working surface, but as a condenser for the working fluid. The rotary member then operates as a centrifugal pump, for sending the denser liquid outward, thus providing a pumping action which is provided integrally with the working member. The liquid which is pumped outward is then exposed to heat, thus changing back to a gaseous state. The gas is then allowed to expand through ducts to impinge upon the working surface, thus completing the cycle.

In a further embodiment of the invention, a rotary Rankine cycle is provided having a rotor with a plurality of blades extending radially outward from its center axis. The rotor is housed in a stator which envelopes the rotor. The stator acts as a boiler and is provided with convergent ducts which direct steam or other vapor to the rotor and the working surface of each rotor blade is coated with an insulating substrate. The opposite surface of the rotor blade acts as a condensation surface and channels on the condensation surface provide baffling to conduct fluid to a condensate outlet on the outer perimeter of the rotor. The rotation of the rotor causes the baffling to function as a centrifugal pump, thus providing a liquid pumping action integral with the rotor so that a separate working fluid pump is not required for the operation of the engine. In order to cool the condensation surface of the rotor, the rotor is cooled by an external coolant supply provided to passageways within the rotor blades. These passageways may terminate in a heat pipe cooling system within the rotor blades in order to obtain a maximum heat transfer efficiency. An external starting mechanism such as a starter/generator is provided.

DESCRIPTION OF THE PREFERRED EMBODIMENT

Figure 1:
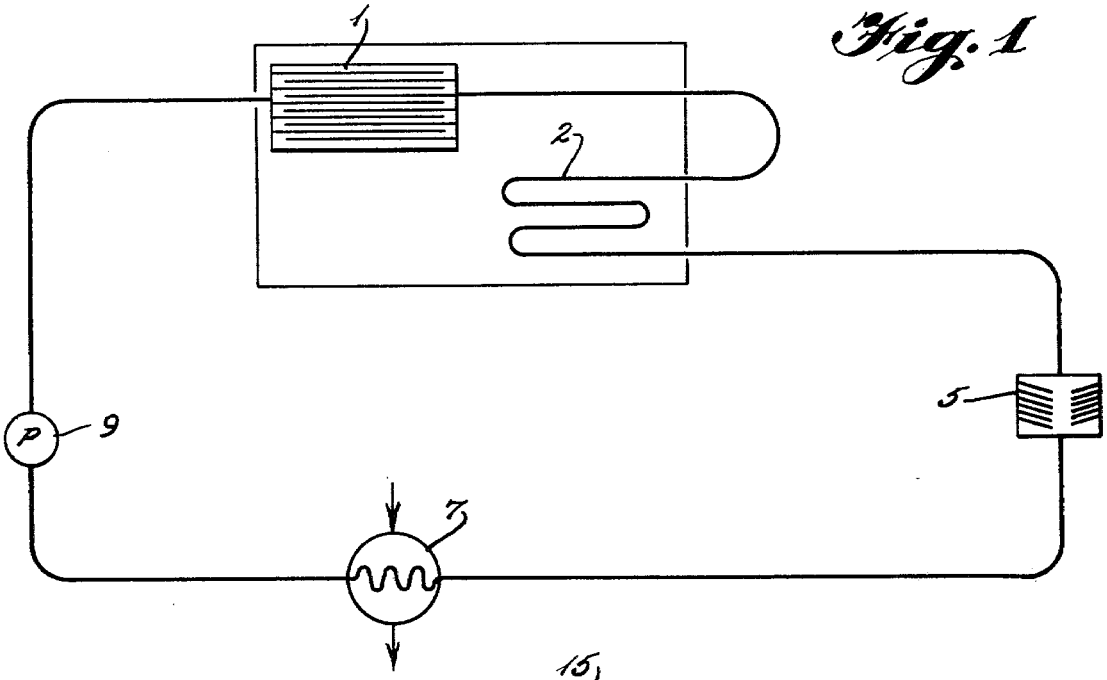
FIG. 1 is a schematic diagram of a Rankine cycle engine.

FIG. 1 is a schematic illustrating a conventional Rankine cycle engine. Referring to that figure, heat is absorbed by the engine in a boiler section 1 and in this stage, a fluid in a liquid state such as, for example, water or liquid flourocarbon is converted to a gaseous state such as steam or gaseous fluorocarbon. Conventionally, additional heat energy is provided to the gas in a superheater 2. Usually the superheater is a part of the boiler and hence the superheater 2 is shown in the drawing as contained within the boiler section 1. The output of the boiler is a super heated vapor which is allowed to flow to an expander 5.

The heat energy of the vapor is converted to mechanical energy in the expander 5, i.e., the energy output of the engine. This component can either be a cylinder and piston arrangement or, as is the case in the present invention, a rotor and stator arrangement. As a result of the extraction of mechanical energy from the fluid, the fluid output of the expander 5 is a cool low-pressure vapor.

The fluid output from the expander 5 is provided to the condenser 7 where a remaining amount of heat in the working fluid is transferred to a coolant and the working fluid is converted from a gaseous state back to a liquid state. In the liquid state, the working fluid is considerably more dense than it is at any time in the gaseous state. This liquid is increased in pressure by a pump 9, thus creating a pressure differential across the pump 9 and consequently, the pressure across the turbine expander 5. This high pressure liquid is then fed to the boiler 1, thus allowing the cycle to be repeated.

Figure 2:
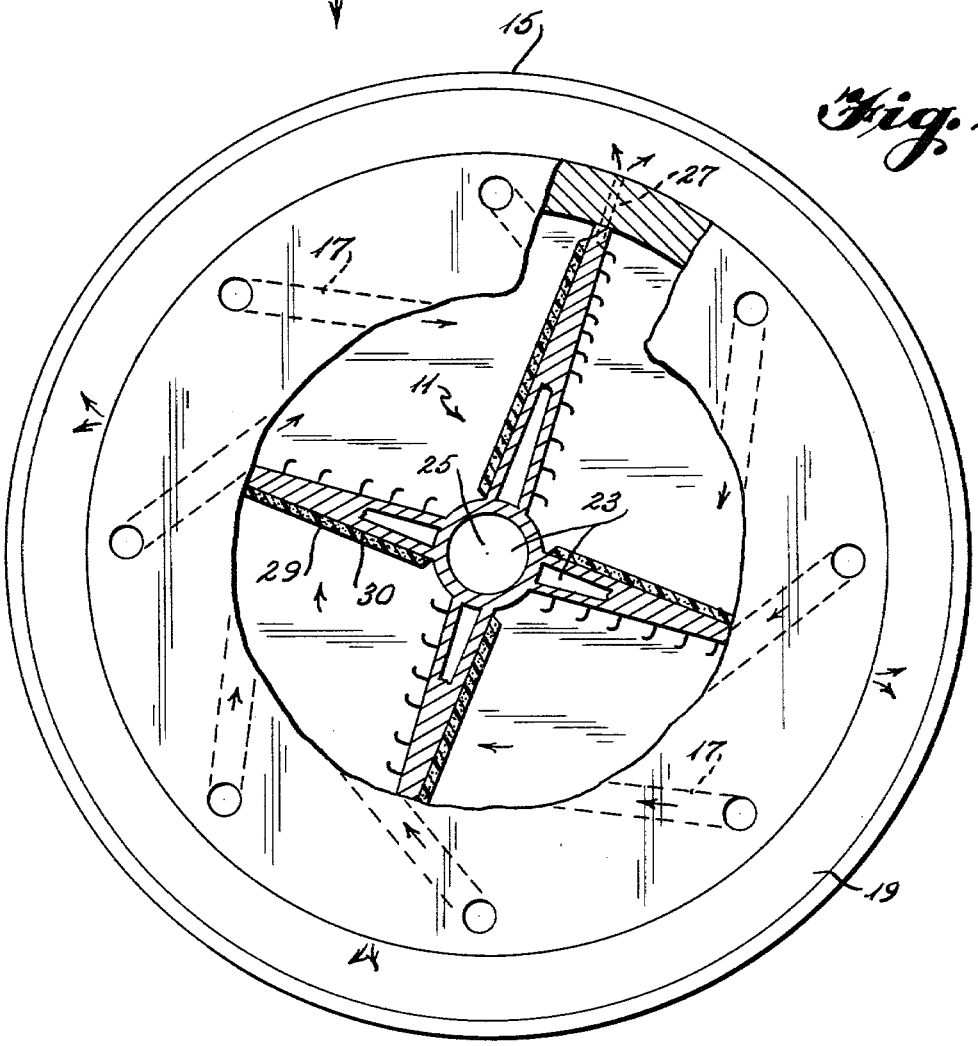
FIG. 2 is a schematic diagram of the modified Rankine cycle engine according to the present invention.

Referring to FIG. 2, as well as FIG. 1, the Rankine cycle engine is provided according to this invention in a single unitary structure. FIG. 2 schematically shows a rotor 11 having a plurality of blades 13, and a stator 15 having expansion ducts 17 therein.

In the configuration of FIG. 2, the function of the boiler 1 is accomplished in an outer chamber 19 of the stator 15. Thus, there is no separate superheater and the function of the superheater 2 is also accomplished in the outer chamber 19.

The function of the expander is accomplished by the expansion ducts 17, which allow vapor to exhaust to the rotor blades 13 of the rotor 11, cooperating with the rotor blades 13.

Each blade 13 is provided with a cooling surface 21 which performs the condenser function. A coolant is allowed to flow through a coolant passageway 23 in order to withdraw heat from the working fluid through the cooling surfaces 21.

Because of the rotational motion of the rotor, the dense condensate is forced outwardly from the center axis 25 of the rotor 11 by centrifugal force. The condensate is allowed to flow along the cooling surface 21 of the rotor blades 13 to an outlet duct 27. The function of the pump 9 is performed by the condensate flow. Thus, it can be seen that a complete Rankine cycle engine can be provided with the working fluid being contained within a single stator 15 and rotor 11 combination.

Figure 3:
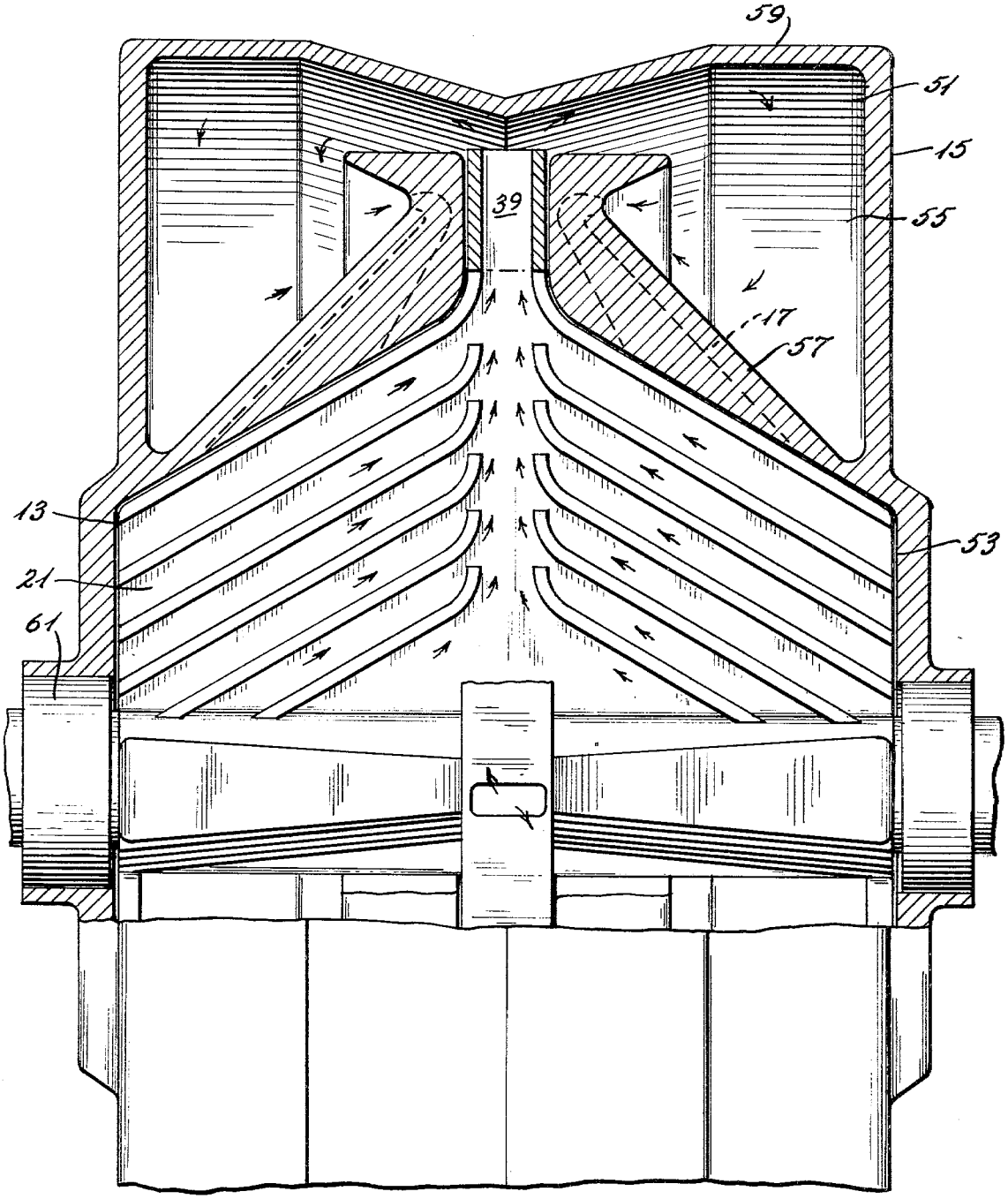
FIG. 3 is a sectional view taken perpendicular to the axis of rotation of the preferred embodiment of the invention.
Figure 4:
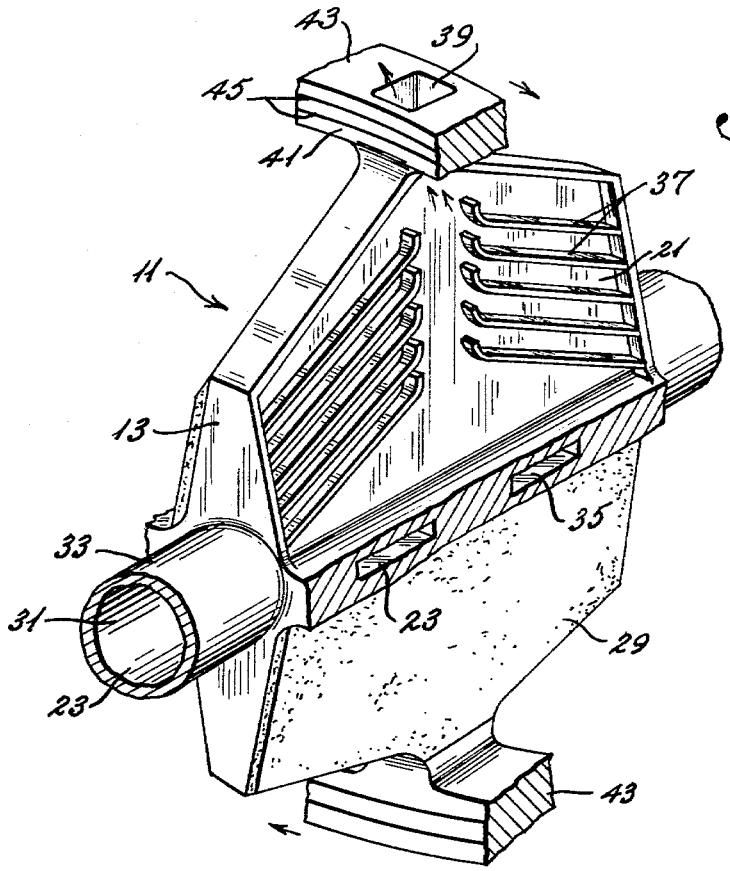
FIG. 4 is a perspective view shown in detail of the rotor blade and condensor surface according to the present invention.
Figure 5:
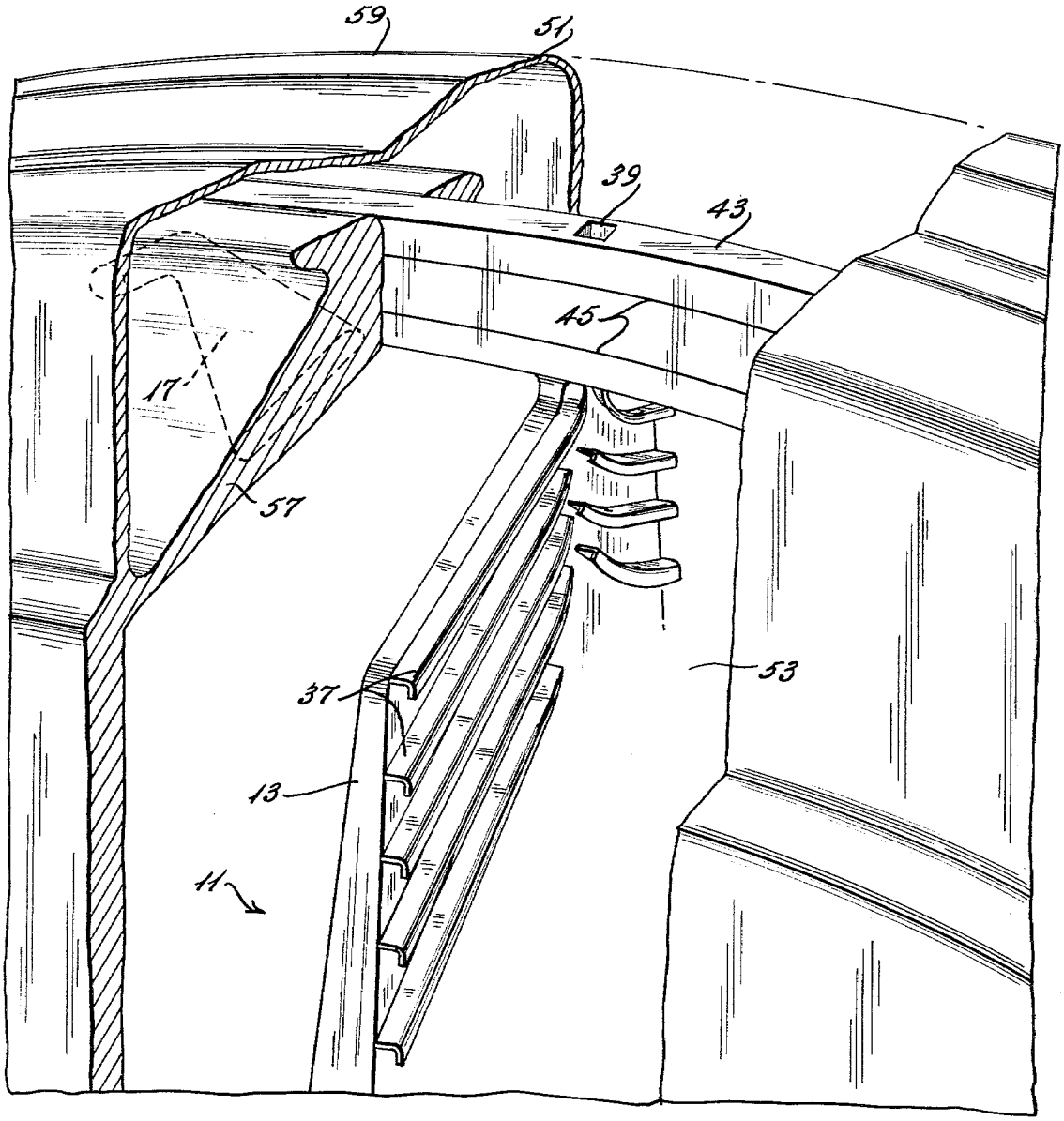
FIG. 5 is a perspective cut-away view of the modified Rankine cycle engine according to the invention showing details of the stator and rotor components.

Referring to FIGS. 3 through 5, the rotor and stator combination of the present invention is shown. The rotor 11 shown separately in FIG. 4, is provided with the cooling surface 21 on one side of each blade 13 and with an insulated surface 29 on the opposite side of each blade 13. The cooling surface 21 may be made of a distinct material and the insulated surface 29 may be formed by spraying an insulating coating 30 thereon, as, for example, by plasma spray deposition techniques.

The coolant passageway 23 is provided with an inlet (not shown) and an outlet 31 located at opposite ends of a center shaft 33 on which the rotor blades are mounted. The coolant is allowed to flow through the passageway 23 into and out of each blade 13 by internal passageways 35 therein. Obviously, the internal passageways 35 are an integral part of the coolant passageway 23.

In order to maximize the heat transfer efficiency between the cooling surfaces 21 and the coolant at the coolant passageways 23, the internal passageways 35 utilize centrifugal pressure to provide accelerated movement of coolant, utilizing the principle of the heat pipe. The heat pipe principle is widely documented, as in U.S. Pat. No. 3,999,400 and U.S. Pat. No. 4,212,347, (which are incorporated herein by reference), and will only be briefly described here.

Heat transfer by heat pipe techniques uses the principles of capillary force to accelerate a cooling fluid past a high temperature area in order to provide the highest flow of a cool fluid at the area of heat contact. While the tendency of coolant fluid circulated merely by pumps and convection flow is to concentrate its lowest density fluid portions adjacent the highest temperature areas reducing heat transfer, the heat pipe, by creating a flow rate in reaction to heat input, increases the actual amount of cooling fluid adjacent to the highest temperature portions. The heat pipe has been applied to cooling atomic piles in nuclear power plants because, at least during normal loads and operating conditions, the heat pipe provides the most effective cooling to the warmest portions of the reactor. The capillary action also provides a syphonic effect, thereby further facilitating the flow of coolant.

The heat pipe principle is particularly advantageous in its application to the present invention because the cooling capacity of the Rankine cycle engine condensor need only be commensurate with normal operation, with emergency shutdown being accomplished externally. For this reason, the cooling system parameters may be chosen for the most economical operation of the engine, rather than for the provision of a theoretical safety factor.

In addition, the use of centrifugal forces, rather than capillary forces, to return the liquid to the heat source can significantly improve the efficiency and power flux of waste heat removal.

Baffles 37 are provided along the condensation surface 21. While these baffles 37 increase the surface area of the condensation surface 21, they also function to form channels for directing condensate to an outlet passageway 39. The baffling 37 and outlet passages 39 operate as a pump causing the condensate to flow outwardly. The pressure differential that can be supported is:

$$\Delta p = \rho\omega^2 \frac{r_o^2 - r_1^2}{2}$$

where:

$\rho$=density of the liquid $\omega=2\pi f$ f=rotational speed of the rotor $r_o$=outer radius of the outlet passageway 39

$r_1$=minimum radius of liquid return passageway

This pressure differential equation does not account for friction losses and assumes that the specific gravity of the vapor relative to the condensate is negligible.

It can be seen from the equation that pressure differential that can be supported by any portion of the baffling 37 or outlet passageway 39 increases as the square of the distance of that portion from the center axis 25 of the rotor 11.

The outer portion 41 of the rotor 11 is formed as a continuation of an annular ring 43 of the rotor 11. The outer ring 43 is sealed against the stator 15 by means of a labyrinth seal schematically represented by concentric lines 45.

The outlet passageway 39 passes through the annular ring 41 and thus past the labyrinth seal 45.

The stator 15 includes an outer housing 51 enclosing a rotor housing space 53 and an outer chamber 55. A duct housing 57 is formed integrally as a part of the stator and separates the outer chamber 55 from the rotor housing space 53. The expansion ducts 17 are formed in the duct housing 57 so as to communicate fluid from the outer chamber 55 to the rotor housing space 53.

The outer chamber 55 functions as the boiler 1. Because of the external combustion operation of the engine, it is preferred to provide heat to the outer chamber 55 through an outer perimeter wall 59.

The rotor 11 rotates in the rotor housing space 53 and is supported therein by sealed bearings 61. The axle 33, in addition to providing a part of the coolant passageway 23, also transmits rotational motion between the rotor and the outside of the engine, thus acting as a drive shaft. The duct housing, as its name implies, houses the ducts 17. The ducts 17 are converging ducts which direct gaseous fluid from the boiler 1 to the thermally-insulated surface 29 of the rotor blades 13.

In the embodiment shown, having a combined boiler 1 and superheater 2 as an outer chamber 55, the ducts 17 conduct fluid from the outer chamber 55 to the rotor housing space 53.

Figure 6:
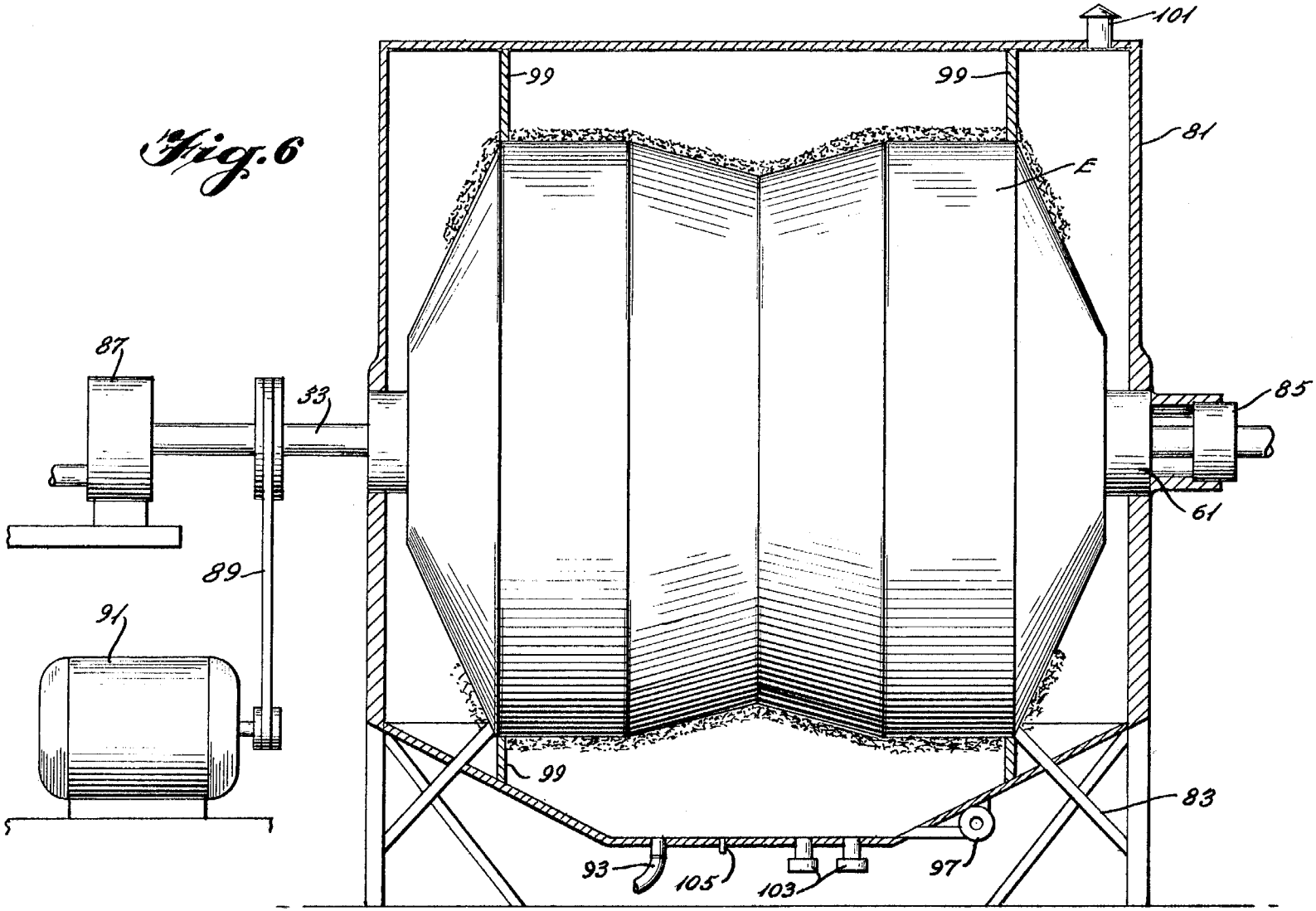
FIG. 6 is a partially cut-away view of the modified rotary Rankine cycle engine of the invention connected to a motor/generator and provided with a catalyst bed for developing heat from a low BTU-density fuel source.

FIG. 6 shows an example of the operation of the engine. Referring to the figure, the engine E is enclosed in a combustion housing 81 supported by a support structure 83, which extends outside the housing 81 to a coolant inlet 85 and a coolant outlet 87. A drive means such as pulley 89 connects the axle 33 to a motor/generator 91. In this case, the motor/generator can operate to initiate rotational motion of the rotor 11 as well as receive power from the rotor 11 once the engine E is operating. The motor/generator 91 may be linked to a public utility power supply by conventional means such as a motor control and synchronous inverter combination (not shown).

It is also possible to provide separate starting and power take-off means (not shown) instead of the motor/generator 91. Furthermore, it is contemplated that in cases where coolant under pressure is not in abundant supply, the coolant inlet 85 may include a coolant pump in order to circulate coolant through the rotor 11.

The combustion housing 81 is provided with a fuel inlet 93. The fuel inlet may be connected to any convenient source of heated or combustible fluid such as sewage gas. Catalyst bed 95 causes the fuel to combust. The catalyst bed 95 may contain any catalyst which would cause the fuel to combust any may include catalytic material salvaged from automobile exhaust systems. The catalyst is retained in the catalyst bed by conventional means such as a high temperature grating (not shown).

Alternatively, combustion may take place outside of the combustion housing 81 and the hot exhaust may then be fed to the combustion housing 81 by the fuel inlet 93.

While it is anticipated that in many cases, the fuel will contain an ample supply of oxygen, a blower 97 is provided to supply any additional oxygen needed. After providing heat to the engine, the combusted fuel or other heated fluid is permitted to pass around combustion baffles 99 and exhaust through an exhaust vent 101. Additional fuel inlets 103 are provided so that it is possible to connect the combustion housing 81 to additional fuel sources. A drain 105 permits condensed combustion by-products to exit the combustion housing 81.

Figure 7:
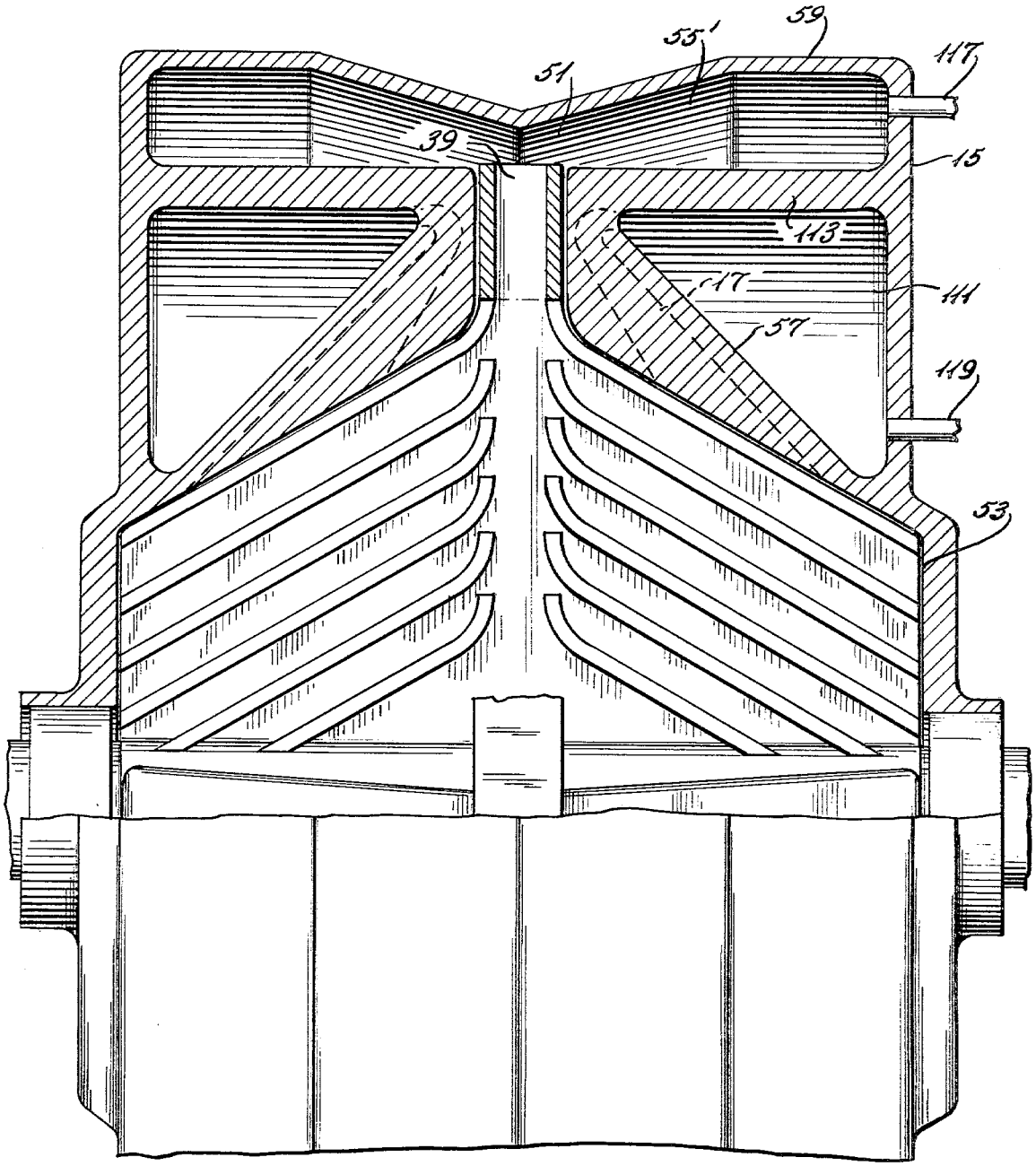
FIG. 7 shows a perspective view of a rotor blade according to the invention showing a modification to the cooling baffle structure.

FIG. 7 shows a modification to the preferred embodiment of the invention in which a separate superheater 2 is provided. A boiler dividing wall 113 extends from the duct housing 57 near the outlet passageway 39 of the rotor 11 to the outer wall 51 of the stator 15. An outer chamber outlet 117 is provided to communicate fluid from the remaining outer chamber 55'. Likewise, a superheater inlet 119 is provided to communicate fluid to the superheater chamber 111. If heat is to be provided directly to the superheater chamber 111 through the outerwall 51, or if the superheater is not to be utilized, the outer chamber outlet 117 is connected directly to the superheater inlet 119. However, if it is desired to externally superheat the working fluid, the outer chamber outlet 117 and the superheater inlet 119 can be connected to a separate superheater (not shown). The expansion ducts 17 communicate fluid from the superheater chamber 111 to the rotor housing space 53. This separate superheater can be used to provide additional energy to the engine when needed. Thus, for example natural gas can be used to produce additional energy for the engine E.

Figure 8:
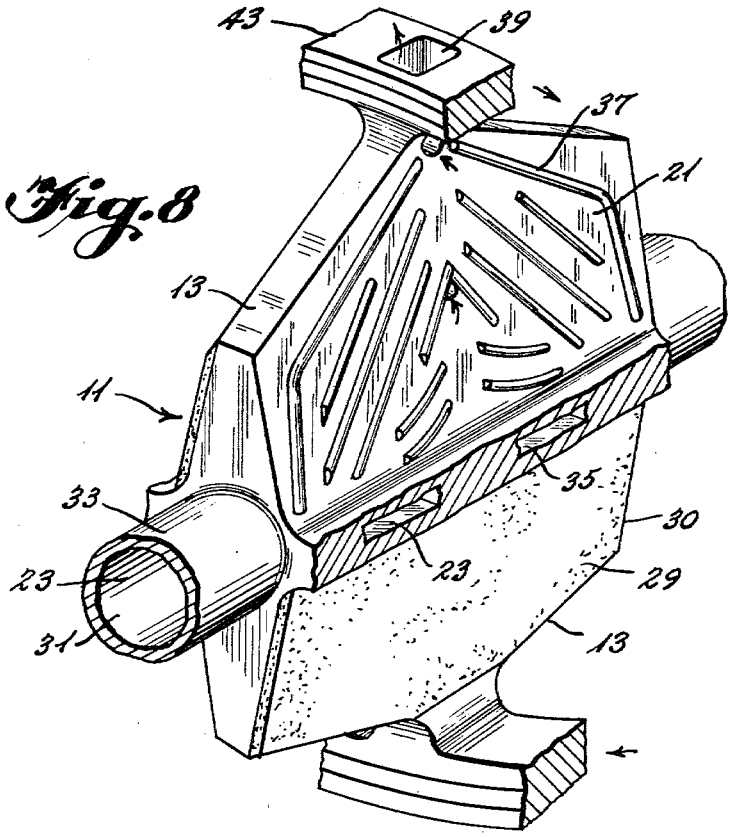
FIG. 8 shows a perspective view of a rotor blade according to the invention showing a further modification to the cooling baffle structure.

It is contemplated that numerous other variations can be made to the invention. For example, referring to FIG. 8, a modified cooling baffle arrangement is shown. This modification is believed to compensate for the likelihood that most of the condensation of working fluid will occur furthest away from the center axis 25. Accordingly, the above description of the preferred embodiments of the invention is not intended to limit the scope of the invention, but rather is intended to demonstrate the concepts therein.

What is claimed is:

1. A rotary Rankine cycle engine comprising:

(a) a rotor having cooling passageways therein, the rotor having a plurality of blades thereon and being rotatable about a center axis;

(b) a stator consisting of a stationary housing having a center axis and a perimeter, the center axis of the stationary housing being coincidental with the center axis of the stationary housing being coincidental the with center axis of the rotor;

(c) a rotor housing area within the stator, the rotor housing area containing the rotor;

(d) a duct housing integral with the stator and located within the stator adjacent the rotor housing area;

(e) an outer chamber, the outer chamber consisting of a fluid space within the stator extending from the outer perimeter to the duct housing;

(f) a heat-receiving portion on the perimeter of the stator, the heat-receiving portion conducting heat from without the stator to within the stator, thereby permitting the outer chamber to act as a boiler section;

(g) fluid ducts within the duct housing, the fluid ducts permitting fluid to flow from the outer chamber to the rotor housing area;

(h) rotor axis bearings, the rotor axis bearings supporting the rotor for rotation about said coincidental axes;

(i) a fluid impingement surface on at least one side of each blade, the fluid impingement surfaces operable to receive fluid from the fluid ducts, thereby acting as working surfaces to convert kinetic energy of fluid received from said ducts to rotational mechanical energy output from the rotor;

(j) a condensation surface on each blade, so that the blade is operable to communicate heat from said condensation surface to said cooling fluid passageways, (k) baffle means on the condensation surface, the baffle means communicating with an outlet end and arranged so that, with the rotor rotating, condensate on the condensation surface is directed by centrifugal force radially outward toward the outer chamber.

wherein, when heat is applied to the heat-receiving portion of the stator and cooling fluid is provided to the cooling passageways of the rotor, a working fluid may be heated in the outer chamber, expand in the fluid ducts and rotor housing area, impinge against the working surface, be condensed at the condensation surface and be directed back to the outer chamber.

2. The engine of claim 1 wherein the fluid ducts are converging ducts so that fluid is increased in velocity as it travels from the outer chamber to the rotor housing area.

3. The engine of claim 1 further comprising sealing means between the outlet of the baffles and the fluid ducts, the sealing means including a fluid friction seal.

4. The rotary Rankine cycle engine of claim 1, wherein the rear side of each blade forms the fluid impingement surface and the opposite side of each blade is the condensation surface.

5. The engine of claim 4 wherein the fluid impingement surface further comprises a thermal insulating material which is applied to the rear side of each blade.

6. The engine of claim 5 wherein the thermal insulated material is deposited on the rear side of each blade by a plasma spraying technique.

7. The apparatus of claims 1 or 4 wherein the baffle means comprises a series of elongate fluid catching surfaces arranged so that, as fluid progresses along the surfaces, the fluid moves continuously away from the center axis toward the outlet end.

8. The engine of claim 7 wherein the outlet portion of the baffles is provided at that portion of the rotor which is furthest from the center axis.

9. The engine of claim 4 wherein the duct housing faces the rotor about the outer circumference of the rotor.

10. The engine of claim 4 wherein the duct housing faces the rotor axially adjacent to the rotor and circumferentially about the axis of the rotor.

11. The engine of claim 4 further comprising an external starting mechanism operable to impart rotational motion to the rotor.

12. The engine of claim 11 wherein the external starting mechanism is a combination starter/generator, so that the starter/generator may be externally provided with electrical power in order to impart said rotational movement, and when the engine is operating after having been started, the starter/generator is operable to convert the power output of the engine into electrical energy.

13. A method of converting energy to mechanical energy in a Rankine cycle comprising:

(a) providing heat to an external surface of a stator member, thereby causing a working fluid within the stator member to absorb the heat;

(b) conducting the working fluid to an inner chamber housing a rotor member;

(c) impinging the fluid against the rotor member;

(d) cooling the rotor member with a coolant;

(e) condensing the fluid on the rotor member;

(f) using centrifugal force of the rotation of the rotor to conduct the fluid outwardly along the rotor member toward the outer surface of the stator member so that the fluid is exposed to said heat.

14. The method of claim 13 wherein the rotor member is cooled by said coolant by using a heat pipe cooling means.

15. A rotary Rankine cycle engine comprising:

(a) a rotor (11) having cooling fluid passageways (23) therein, the rotor (11) rotating about a center axis (25) and having a plurality of blades (13) thereon;

(b) a stator (15) consisting of a stationary housing (51) having a center axis and a perimeter, the center axis of the stationary housing (51) being coincidental with the center axis (25) of the rotor;

(c) a rotor housing area (53) within the stator, the rotor housing area (53) containing the rotor (11);

(d) a duct housing (57) integral with the stator (15) and located within the stator (15) adjacent the rotor housing area (53), the duct housing (57) facing the rotor (11) adjacent to the rotor (11) and extending about the circumference thereof;

(e) an outer chamber (55), the outer chamber (55) consisting of a fluid space within the stator (15) extending from the perimeter to the duct housing (57);

(f) a heat-receiving portion (59) on the perimeter of the stator (15), the heat-receiving portion (59) conducting heat from without the stator (15) to within the stator (15), thereby permitting the outer chamber (55) to act as a boiler section (11);

(g) converging fluid ducts (17) within the duct housing (57), the fluid ducts (17) permitting heated gaseous fluid to increase in velocity and flow from the outer chamber (55) to the rotor housing area (53);

(h) rotor axis bearings (63), the rotor axis bearings (63) supporting the rotor (11) for rotation about said coincidental axes (25);

(i) a fluid impingement surface (29) on the rear side of each blade (13), the fluid impingement surfaces (29) operable to receive fluid from the fluid ducts (17), thereby acting as working surfaces to convert kinetic energy of fluid received from the fluid ducts (17) to rotational mechanical energy output from the rotor (11), the fluid impingement surfaces (29); consisting of an insulating substrate material (30) deposited on said rear side of each blade;

(j) a condensation surface (21) on a front side of each blade (13) so that the blades (13) are operable to communicate heat from said condensation surface (21) to said cooling fluid passageways (23);

(k) baffle means (37) on the condensation surface (21), the baffle means (37) communicating with an outlet end (39) and arranged so that condensed fluid entrains on the baffle means (37) and is conducted by centrifugal force in a direction away from the center axis (25) and toward the outlet end (39), the outlet end (39) directing the condensate into the outer chamber (55), thus pumping the condensate to the outer chamber (55);

(l) inlet and outlet (31) means along the center axis (25) of the rotor (11) and communicating with the cooling fluid passageways (23), so that coolant may be provided to the rotor (11) at the inlet and exhausted from the rotor at the outlet (31);

(m) wherein when heat is applied to the heat-receiving portion (59) of the stator (15) and cooling fluid is provided at the inlet means, a working fluid will be heated in the outer chamber (55), expand in the fluid ducts (17) and rotor housing area (53), impinge against the fluid impingement surfaces (29), be condensed at the condensation surfaces (21) and be directed back to the outer chamber (55).

16. The rotary Rankine cycle engine of claims 1, 3 or 14 wherein the fluid is converted to a superheated vapor in the boiler and the fluid is converted from a vapor to a liquid on the condensation surfaces, the liquid being significantly greater in specific gravity than the vapor, thereby permitting the liquid to displace vapor as it is directed by centrifugal force radially outwardly.

17. The rotary Rankine cycle engine of claims 1 and 15 wherein the fluid passageways comprise centrifugal heat pipe heat exchangers within the rotor blades.

* * * * *